US005469936A

United States Patent [19]

Lauga et al.

[11] Patent Number: 5,469,936

[45] Date of Patent: Nov. 28, 1995

[54] SUPPORT DEVICE FOR AN ITEM OF RETRACTABLE STREET FURNITURE HAVING ELECTRICAL ACTUATION

[76] Inventors: Olivier Lauga, Lôhissemant de Condol, 8A800 Grazac; Nicolas Revol, 39 rue de Joscou, 75008 Paris; Lionel Murou, 6 Piece de Belo, Jassongy 74140, all of France

[21] Appl. No.: 253,852

[22] Filed: Jun. 3, 1994

[30] Foreign Application Priority Data

Jun. 4, 1993 [FR] France ..... 93 06720

[51] Int. Cl.[6] ..... B66F 7/02

[52] U.S. Cl. ..... 187/205; 187/251; 187/255; 187/270; 187/289

[58] Field of Search ..... 187/205, 250, 187/251, 255, 270, 276, 289, 296, 297, 311, 312, 404; 220/408, 409, 908; 248/907

[56] References Cited

U.S. PATENT DOCUMENTS

| | | | |
|---|---|---|---|
| 153,765 | 8/1874 | Greenbaum et al. | 220/409 |
| 1,884,447 | 10/1932 | White . | |
| 2,528,056 | 10/1950 | Henry | 220/409 |
| 3,086,430 | 4/1963 | Emmel | 94/1 |
| 3,800,973 | 4/1974 | Weaver | 220/409 |
| 4,269,285 | 5/1981 | Ohkoshi et al. | 187/270 |
| 4,919,563 | 4/1990 | Stice . | |

FOREIGN PATENT DOCUMENTS

| | | |
|---|---|---|
| 0177895 | 10/1984 | European Pat. Off. . |
| 2621625 | 12/1987 | France . |
| 2650009 | 7/1989 | France . |
| 8002576 | 11/1980 | WIPO . |

*Primary Examiner*—William E. Terrell
*Assistant Examiner*—Dean A. Reichard

[57] ABSTRACT

A support device for an item of retractable street furniture having electrical actuation is provided having a stationary box installed in the ground; moving equipment housed in the box and including a top support plate for supporting the item of street furniture, the equipment being movable between a high position in which the item of street furniture emerges from the box above the level of the ground, and a low position in which the item of street furniture is retracted into the box so that the top portion thereof does not project above ground level; an electrical motor and gear box unit; and a transmission for converting the rotary motion of the motor and gear box unit into translation motion of the moving equipment between its high position and its low position. According to the invention, the motor and gear box unit and the transmission form a reversible assembly so that in the absence of power being fed to the motor and in the absence of braking or locking being applied from outside the assembly, the moving equipment moves back on its own to its low position under gravity.

7 Claims, 3 Drawing Sheets

SUPPORT DEVICE FOR AN ITEM OF RETRACTABLE STREET FURNITURE HAVING ELECTRICAL ACTUATION

The invention relates to a support device for an item of retractable street furniture having electrical actuation.

BACKGROUND OF THE INVENTION

To keep the following description simple, consideration is given by way of example mainly to a retractable bollard which serves, depending on whether it is retracted or not, either to allow or to prevent access to a given urban zone. However that example should not be considered as being limiting in any way, and the teaching of the invention can be applied to other elements of retractable street furniture of a wide variety of types, such as signposts, technical cabinets, containers, dust bins, etc.

Actuator-containing support devices for retractable bollards (or for other retractable items of street furniture) can be subdivided into two types: firstly devices having an electropneumatic or an electrohydraulic actuator which are themselves driven by a jack fed with fluid under pressure from a compressor, and secondly electromechanical devices, which constitute the category to which the present invention relates.

For example, one such device having an electrical actuator is described in FR-A-2 650 009, which describes a box installed in a pit in the ground and containing a retractable bollard that is deployed under the control of an "electrical jack" type electrical actuator, i.e. an actuator in which an electric motor drives a moving rod by means of a worm screw or of a screw-and-nut type mechanism. That actuator (which includes the electric motor, a stepdown gear train, a transmission, etc.) is located in a low position at the bottom of the box, and the vertical moving rod points upwards and is connected to a raisable plate carrying the bollard.

Given various limitations inherent to its structure, that prior art device is incapable of satisfying the ever more severe constraints that are imposed on apparatuses of that type by local authorities, and others.

Firstly, it is considered that such a device should not require a pit to be dug deeper than 80 cm so as to ensure that there is no risk of interfering with pipes, cables, etc. This means that the device must be very compact, particularly if it is desired that when the bollard or other item of street furniture is in the deployed position, it should be of sufficient height to enable it to act as an obstacle. In this respect, since the structure of the device of FR-A-2 650 009 has its actuator situated at the bottom of the box and surmounted by the moving plate that carries the bollard, the maximum possible height for the bollard is reduced to a value of less than half the depth of the pit receiving the box, and this is particularly constraining; thus, the text of that document mentions one meter as being a typical pit depth for receiving a bollard of height 400 mm, which proportions are inappropriate in most situations.

Secondly public safety constraints require the bollard to be capable of "fail-safe" operation, i.e. in the event of its electrical power supply being interrupted, particularly in the event of a power cut, a bollard that is in the raised position should move back down immediately and of its own accord into the retracted position, e.g. so as to ensure that emergency services have access. The retractable electrical bollard device of the above-mentioned document does not satisfy this requirement, and in the event of power failure the bollard is retractable only by hand (i.e. a person is required to actuate a mechanical device provided for that purpose on the bollard so as to cause it to retract back into its box); "fail-safe" in the meaning mentioned above would require the installation of backup batteries and of a mains power cut detection system to enable the bollard to return automatically to its retracted position in the event of a power cut. Such additional equipment would both complicate the design and maintenance of the bollard (in particular because of the batteries), and would also make it considerably more expensive, and even then it would not achieve total reliability since genuinely fail-safe operation must be capable of being achieved without relying on backup batteries.

Thirdly, it is highly desirable for the deployment or retraction speed of the bollard to be high, typically of the order of 2 seconds in either direction. Electropneumatic bollards satisfy this requirement well; in contrast, known electrical bollards do not enable such high speed to be achieved, with the time they require for deployment or retraction typically being about eight seconds, i.e. four times too long.

Fourthly, it is essential for the device to be protected against the risk of immersion in the event of water or mud collecting in the bottom of the box. The bottom of the box is naturally the region that is the most exposed and the most likely to collect unwanted infiltrations, in spite of the precautions that will normally be taken to drain fluids away. For this purpose, the device of the above-mentioned documents describes a complex structure designed to provide reinforced insulation for the motor and for the other portions of the electrical actuator, all of which are situated at the bottom of the box, in particular by means of a structure of concentric telescopic tubes that protect the actuator which is positioned axially.

Fifthly, given the very wide range of user requirements, it appears to be desirable to be possible to fit the support device with bollards or other items of street furniture that are highly variable as a function of demand, while nevertheless retaining a common universal basic support. It is also desirable to be able to change the bollard without difficulty, e.g. after a collision, and without that requiring the entire device to be changed. This means that it is necessary to have a lifting support structure which is essentially independent of the structure of the bollard, and that is not the case of the device in the above-mentioned document, where the above-mentioned design based on concentric telescopic tubes causes the structure of the bollard to be indissociable from the structure of the lifting device.

Sixthly, it appears in practice to be desirable to be able to power the device directly from mains voltage (220 V), rather than from low voltage (12 V or 24 V) so as to avoid the need for transformers, rectifiers, safety backup power supplies including storage batteries (see above), etc. However, direct power from mains voltage requires a structure which intrinsically avoids the electrical dangers that are associated with such direct connection to mains. Here again, given the structure of the device of the above-mentioned document, where the electrical components are located at the bottom of the box, it is necessary to provide feeds through a multitude of walls via sealing grommets or glands, thus complicating implementation and even then failing to provide maximum safety because it is still possible for water to infiltrate at all levels.

Finally, given their intended use, all such devices must naturally be very robust and very reliable in spite of severe operating conditions and rates, typically 600 maneuvers per day with maximum rates exceeding 120 maneuvers per hour.

The various requirements specified above are so constraining that, until now, no electrically retractable bollard has been capable of satisfying all of them.

That is why the market has been clearly dominated until now by retractable bollards that are electropneumatic, in spite of their greater complexity (due to the presence of electrical energy being transformed into pneumatic energy by means of a compressor), and in spite of being more difficult to install and maintain (since it is necessary to use personnel having a good understanding of the technology of pneumatic apparatuses).

OBJECTS AND SUMMARY OF THE INVENTION

An object of the invention is to provide a support device for items of retractable street furniture, such as a retractable bollard, having electrical actuation and satisfying all of the above-mentioned requirements, in particular that of being fail-safe, while presenting a structure that is both simple and robust, and thus being cheap and reliable.

The device of the invention is of the general type described in above-mentioned FR-A-2 650 009, i.e. comprising: a stationary box installed in the ground; moving equipment housed in the box and including a top support plate for supporting the item of street furniture, said equipment being movable between a high position in which said item of street furniture emerges from the box above the level of the ground, and a low position in which the item of street furniture is retracted into the box so that the top portion thereof does not project above ground level; an electrical motor and gear box unit; and a transmission for converting the rotary motion of the motor and gear box unit into translation motion of the moving equipment between its high position and its low position.

According to the invention, the motor and gear box unit and the transmission form a reversible assembly so that in the absence of power being fed to the motor and in the absence of braking or locking being applied from outside said assembly, the moving equipment moves back on its own to its low position under gravity.

According to advantageous subsidiary characteristics:

the motor and gear box unit is carried by the moving equipment;

the motor and gear box unit includes an electrically-controlled shaft brake of the "current ON" type, i.e. that is continuously activated after the equipment has reached its high position, and so long as an electrical power supply voltage for the device is available upstream therefrom;

the transmission comprises at least one deformable linear drive member such as a cable, a strap, a belt, or a roller chain co-operating with the outlet shaft of the motor and gear box unit, and having at least one of its ends fixed to a high point of the box;

the other end of the deformable linear member is either connected to a drum mounted at the outlet from the motor and gear box unit with the member being wound up on said drum, or else it is fixed to a low point of the box, the deformable linear member engaging with a drive wheel mounted at the outlet of the motor and gear box unit; and the moving equipment is configured to form a bell capable, in the event of the device being submerged, of enclosing a residual volume of air, the motor and gear box unit being mounted inside said bell at a level ensuring that under all circumstances it remains in said residual volume of air.

BRIEF DESCRIPTION OF THE DRAWINGS

Embodiments of the device of the invention are described with reference to the accompanying figures.

MORE DETAILED DESCRIPTION

Figure 1:
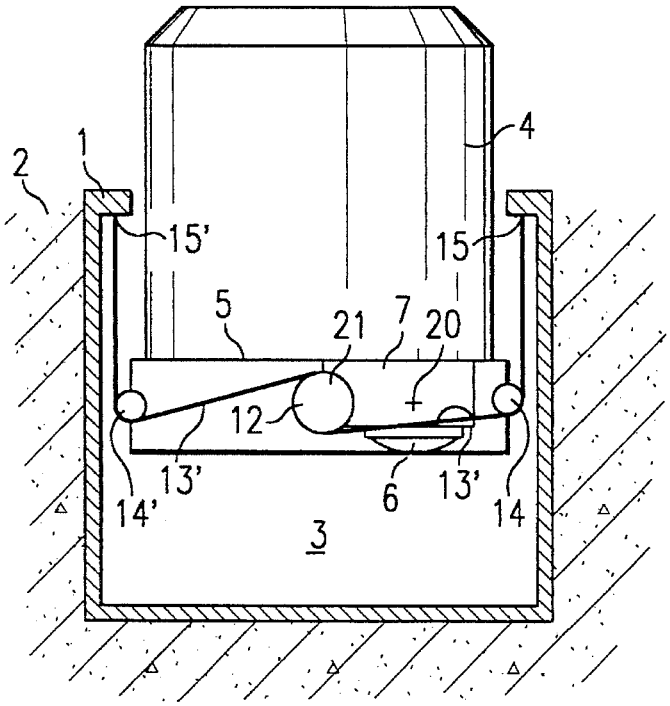
FIG. 1 is a diagram of a retractable bollard device implemented in accordance with the teaching of the invention.

FIG. 1 shows a retractable bollard device of the invention in which reference 1 designates a box buried in the ground 2 so as to define a closed inside volume 3 into which the bollard 4 can be retracted. The bollard is carried by moving equipment 5 which advantageously, in addition to its role of supporting the bollard, also supports a motor 6 and a stepdown gear box 7 (visible in particular at the top of FIG. 5). In a manner characteristic of the invention, the stepdown gear box 7 is a reversible member constituted, for example, by a train of gears 8, 9, and 10 having an outlet driving a shaft 11 at the end of which, in this embodiment, there is fixed a drum 12, preferably with a drum being fixed at each of the ends of the shaft for reasons of symmetry to balance operation of the device. A respective strap 13, 13' is wound onto (or is unwound from depending on the direction of drive) each of the drums 12 and 12', which straps, after passing over respective return pulleys 14, 14' are fixed via their ends 15, 15' to the top portion of the box 1.

Provision is also made (FIG. 5) for means for guiding the moving equipment in its vertical translation motion, e.g. shoes 16 that co-operate with rails or columns 17.

According to another characteristic aspect of the invention the motor also includes, at the end of its shaft, an electromagnetic brake 18 whose function and control are explained below.

Given the structure described above, rotation of the drum 12 (or of the drums 12 and 12' if two symmetrical drums are provided) causes the length of the strap 13 (or of the two straps 13, 13') to be shortened, thereby raising the moving equipment 15 and consequently causing the bollard 4 to move out from the ground.

In the opposite direction, because of the reversible nature of the gear box 7, simply switching off the power supply to the motor will release the drums 12 and 12' and the bollard will drop down of its own accord under gravity into retracted position at the bottom of the housing. Naturally, appropriate damping means (not shown) may be provided to slow down the descent of the bollard and/or to ensure that it strikes the bottom of the box less roughly. In any event, this descent stage is very short, typically occupying about 2 seconds, and it takes place as soon as the power is cut, without requiring any active intervention, thus complying fully with the above-mentioned fail-safe concept.

In addition, the structure shown is very compact, in particular with respect to the overall vertical extent of the device, thereby making it possible to provide a relatively large ratio between the height of the retractable bollard and the depth of the hole required for receiving the device, unlike prior art electrical devices in which the above ratio was limited to a value of about 50%.

For a reasonable power rating of the motor, it is possible to select a gear ratio such that the bollard is raised in a period of about 2 seconds, which length of time is in any event much shorter than the times usually encountered with known electrical devices.

Finally, it can be seen that the structure proposed is entirely independent of the type of bollard or even of the kind of item of street furniture that is concerned, which item is therefore easily adaptable or interchangeable without there being any need to act on the various components of the lifting device proper.

Figure 5:
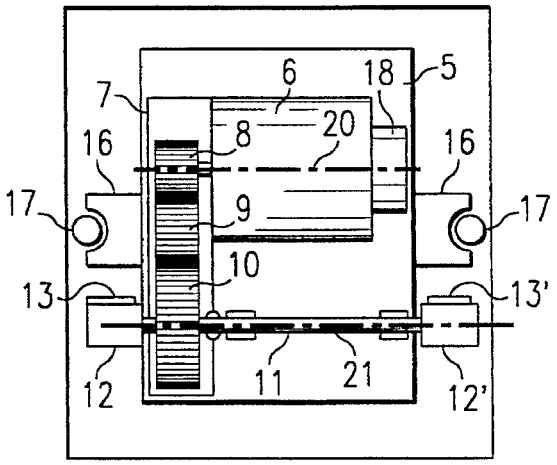
FIG. 5 is a diagrammatic plan view of the FIG. 1 embodiment.

It will also be observed that the motor and gear box unit shown in FIG. 5 presents two aspects that are extremely advantageous, namely: i) it is reversible since it makes use of a gear train that does not include any worm screws (as are to be found in most of the gear boxes used in this type of motor and gear box unit); and ii) it makes it possible to have an outlet shaft 21 that is parallel to the shaft 20 on the axis of the motor, thereby ensuring that the mechanism is symmetrical and also providing greater compactness for the assembly.

For example, in a system for raising a concrete bollard weighing 60 kg, it is possible to use a motor and gear box unit having an outlet power of 400 W that is powered by a 220 V single phase asynchronous motor. The nominal speed of the motor may then be 1500 revolutions per minute (rpm) giving a speed of 100 rpm at the outlet of the gear box in conjunction with a nominal torque of 35 N.m which is sufficient to enable the bollard to be fully raised in less than 2 seconds.

In a variant, it is possible for the strap 13 to be replaced by some other functionally similar linear deformable element, e.g. a cable, a roller chain, a cog belt, etc.

Figure 2:
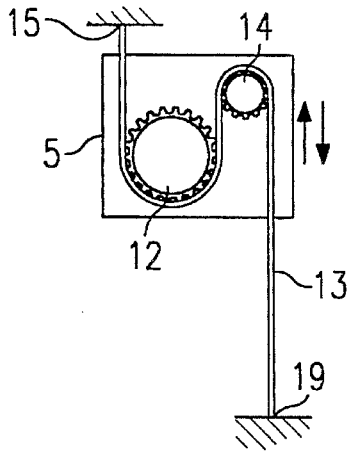
FIG. 2 shows a possible variant embodiment of the FIG. 1 device.

In addition, it is also possible to provide a configuration such as that shown in FIG. 2 where the member 13 (preferably constituted in this case by a roller chain or by a cog belt) is of fixed length and is fixed at its two ends 15 and 19 to the top and the bottom of the box respectively. Instead of being a windup drum as in the preceding embodiment, the member 12 is then a toothed wheel or sprocket that engages the member 13, it being possible to provide a return pulley 14 to ensure co-operation between the members 12 and 13 over a greater range. The wheels 12 and 14 naturally have their shafts secured to the moving equipment 5, with rotation of the wheel 12 displacing said moving equipment 5 in vertical translation. On the same principle, the member 13 could, in a variant, be a rigid member such as a rack running from top to bottom of the box and the toothed wheel 12 could mesh therewith.

Figure 3:
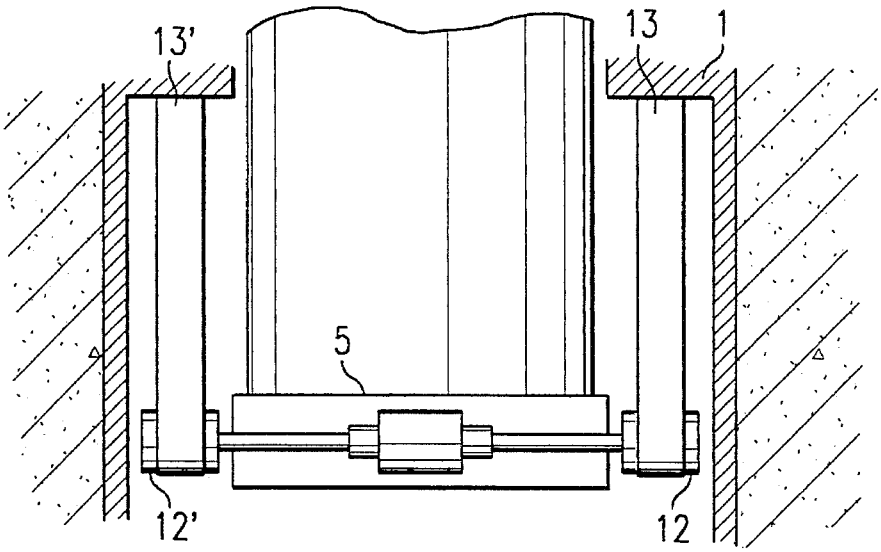
FIG. 3 shows another embodiment of the device of the invention.
Figure 6:
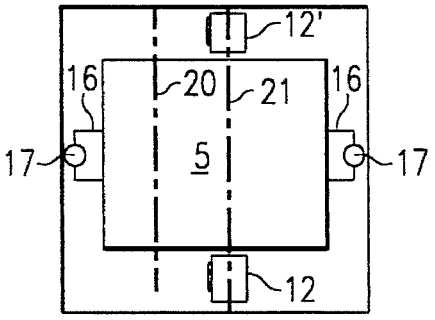
FIG. 6 is a diagrammatic plan view of the FIG. 3 embodiment.

Other embodiments may also be envisaged, for example those shown in FIG. 3 (elevation view) and in FIG. 6 (plan view). In this case, the straps 13 and 13' are wound directly onto the drums 12 and 12' without interposing return pulleys. It may also be observed that in this variant the axis 20 of the motor and the axis 21 of the two pulleys 12 and 12' are parallel to each other and perpendicular to the plane defined by the guide rails 17 (unlike the configuration shown in FIG. 5, for example).

Figure 4:
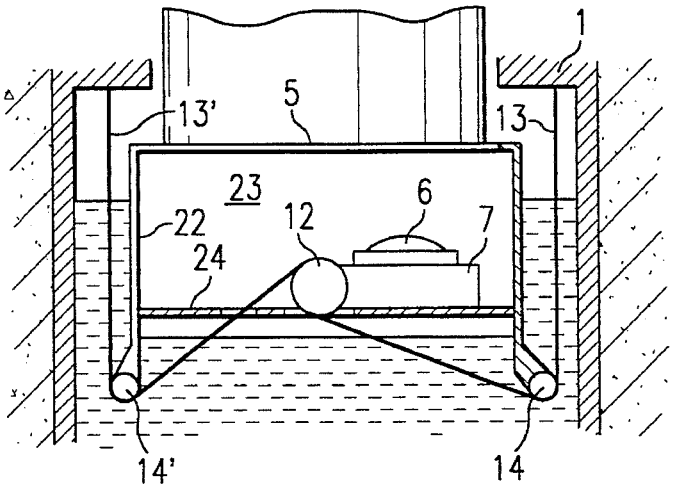
FIG. 4 shows a variant of the FIG. 1 embodiment, making it possible, in particular, to protect the electrical members of the device against the risk of flooding.
Figure 7:
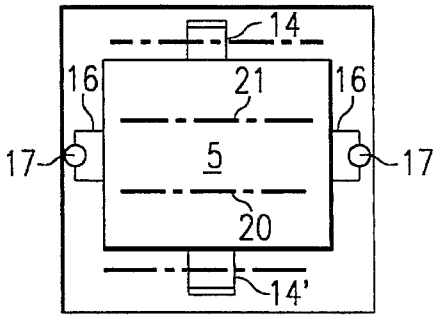
FIG. 7 shows a variant of the preceding embodiments.

In the variant of FIG. 4 (elevation view) and of FIG. 7 (plan view), the basic structure is similar to that of FIG. 1, having drums 12 and 12' on which straps 13 and 13' are wound that pass over pulleys 14 and 14' secured to the moving equipment 5. However, in this case the moving equipment is in the form of a bell that includes, beneath the plate supporting the bollard, a continuous side wall 22 defining a downwardly open volume 23 and suitable for trapping a residual volume of air even in the event of the device being submerged (violent storm, etc.). Thus, the motor 6 and the gear box 7 which are mounted on a support chassis 24 remain under all circumstances clear of the water, in a pocket of air.

There now follows a detailed description of the electromagnetic brake 18 which is advantageously of the "current ON" type (i.e. it acts as a brake when it is fed with current and the brake is released when it is no longer fed with current). This brake, located at the head of the drive shaft, provides very good resistance to output force from the gear box since the gear box multiplies the resistance it provides. It is thus possible to use a low voltage brake that consumes little power (typically 24 V and 7 W). The brake is powered continuously so long as the bollard is in its high position. In the event of a power cut, the brake immediately releases the drive shaft and, because the transmission is reversible, this has the effect of allowing the bollard to move back down into its housing merely under gravity.

Figure 8:
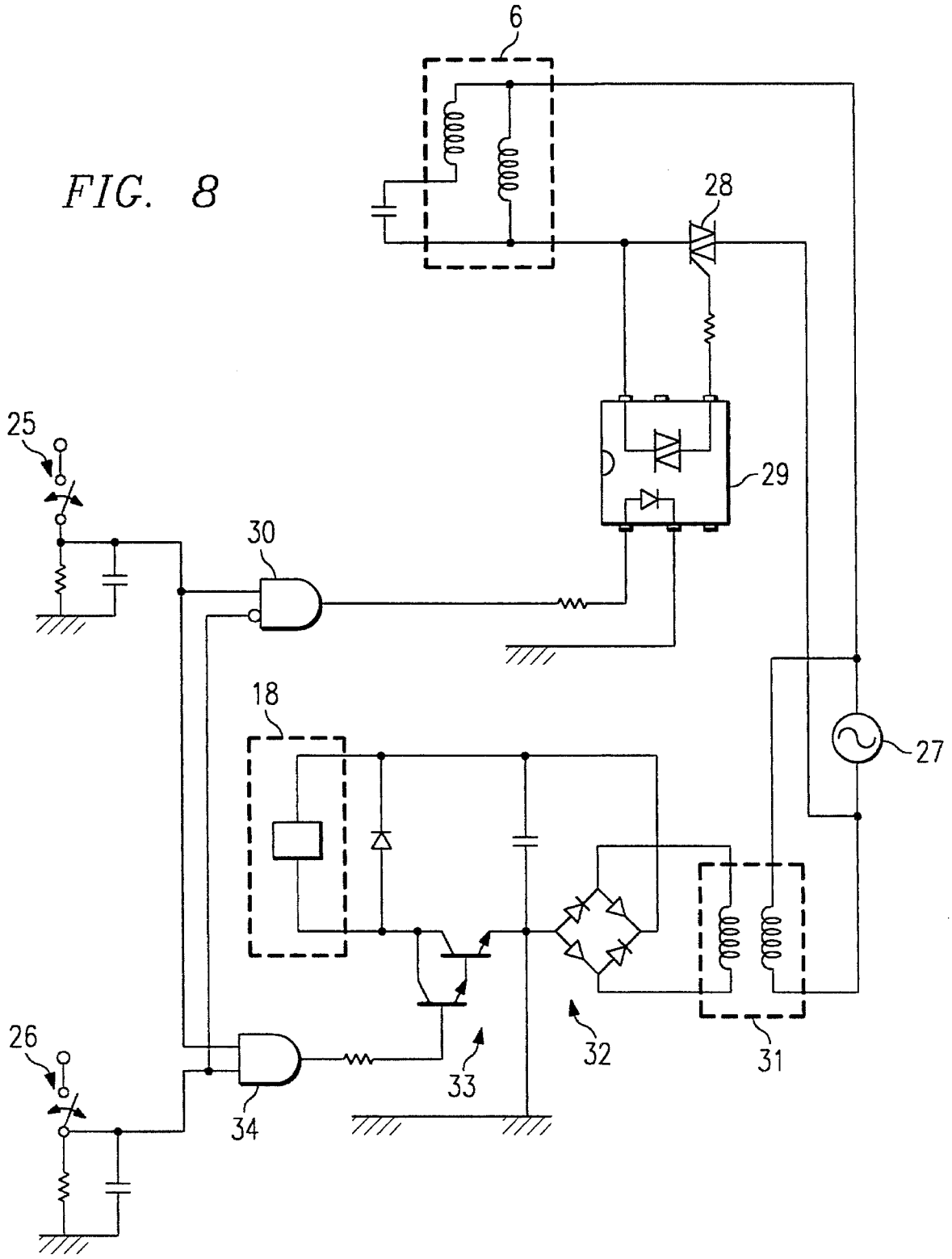
FIG. 8 shows an example of an electrical circuit suitable for controlling the device of the invention.

FIG. 8 shows an example of a power supply and control circuit for the device of the invention. The circuit has two switches, namely a control switch (under manual or automatic control) 25 for causing the bollard to be raised (the switch should then be kept closed) and a top end-of-stroke switch 26, e.g. an inductive type sensor, that closes when the bollard has reached its high point, and it remains closed so long as the bollard remains at that point.

The circuit may be directly powered at 27 from 220 V mains, particularly when the embodiment shown in FIG. 4 is used since that embodiment ensures that there is no danger of the motor and the associated electrical circuits coming into contact with water. The motor 6 is powered from mains via a triac 28 controlled by an optocoupler 29 disposed at the output of a gate 30 that is under the control of the switches 25 and 26 (the person skilled in the art will immediately understand how the circuit operates, so its operation is not described in greater detail below). The electromagnetic brake 18 is powered with low voltage from a stepdown transformer 31 and a rectifier and filter circuit 32 via a Darlington amplifier 33 under the control of a gate 34 that is likewise controlled by the positions of the switches 25 and 26 so that when the bollard reaches its high position (switch 26 closes), the circuit switches off the power supply to the motor and switches on the electromagnetic brake.

We claim:

1. A device for supporting an item of retractable street furniture having electrical actuation, the device being of the type comprising:

a stationary box installed in the ground;

moving equipment housed in the box and including a top support plate for supporting the item of street furniture, said equipment being movable between a high position in which said item of street furniture emerges from the box above the level of the ground, and a low position in which the item of street furniture is retracted into the box so that a top portion thereof does not project above ground level;

an electrical motor and gear box unit; and a transmission for converting a rotary motion of the motor and gear box unit into translation motion of the moving equipment between its high position and its low position;

wherein the motor and gear box unit and the transmission form a reversible assembly so that in the absence of power being fed to the motor and in the absence of braking or locking being applied from outside said assembly, the moving equipment moves back on its own to its low position under gravity.

2. A device according to claim 1, in which the motor and gear box unit is carried by the moving equipment.

3. An item of street furniture according to claim 1, in which the motor and gear box unit includes an electrically-controlled shaft brake that is continuously activated after the equipment has reached its high position, and so long as an electrical power supply voltage for the device is available upstream therefrom.

4. A device according to claim 2, in which the transmission comprises at least one deformable linear drive member co-operating with an outlet shaft of the motor and gear box unit, and having at least one of its ends fixed to a high point of the box.

5. A device according to claim 4, in which the other end of the deformable linear member is connected to a drum mounted at an outlet from the motor and gear box unit with the member being wound up on said drum.

6. A device according to claim 4, in which the other end of the deformable linear member is fixed to a low point of the box, the deformable linear member engaging with a drive wheel mounted at an outlet of the motor and gear box unit.

7. A device according to claim 1, in which the moving equipment is configured to form a bell capable, in the event of the device being submerged, of enclosing a residual volume of air, the motor and gear box unit being mounted inside said bell at a level ensuring that it remains under all circumstances in said residual volume of air.

* * * * *